US006427418B1

(12) United States Patent
Zell

(10) Patent No.: US 6,427,418 B1
(45) Date of Patent: Aug. 6, 2002

(54) METHOD OF TEXTURING DRYWALL CORNER BEAD AND WALL ADJACENT THE CORNER BEAD

(76) Inventor: Randall W. Zell, 1812 N. 30$^{th}$ Pl., Phoenix, AZ (US) 85032

( * ) Notice: Subject to any disclaimer, the term of this patent is extended or adjusted under 35 U.S.C. 154(b) by 0 days.

(21) Appl. No.: 09/551,057

(22) Filed: Apr. 18, 2000

(51) Int. Cl.$^{7}$ ..... E04B 1/00

(52) U.S. Cl. ..... 52/754.05; 52/745.06; 52/745.19; 52/287.1

(58) Field of Search ..... 52/255, 741.41, 52/745.21, 287.1, 256, 257, 288.1, 745.05, 745.06, 745.19; 29/460

(56) References Cited

U.S. PATENT DOCUMENTS 290,750 A * 12/1883 Cuhna ..... 52/255
2,147,667 A * 2/1939 Patterson
3,350,825 A * 11/1967 Rillo ..... 52/287.1
5,442,886 A * 8/1995 Iacobelli ..... 52/255
5,778,617 A * 7/1998 Free ..... 52/255
5,904,016 A * 5/1999 Koenig et al. ..... 52/255
5,943,835 A * 8/1999 von Saint-George ..... 52/287.1
6,148,573 A * 11/2000 Smythe, Jr. ..... 52/255

* cited by examiner

*Primary Examiner*—S. Thomas Hughes
*Assistant Examiner*—Steven Blount
(74) *Attorney, Agent, or Firm*—Tod R. Nissle, P.C.

(57) ABSTRACT

A method and apparatus for texturing a wall. The method selects a texture pattern and provides a corner bead with the selected texture. After the corner bead is mounted, the same texture pattern is formed on drywall adjacent the corner bead, after which the texture pattern on the drywall is painted along with the corner bead.

2 Claims, 3 Drawing Sheets

FIG. 1
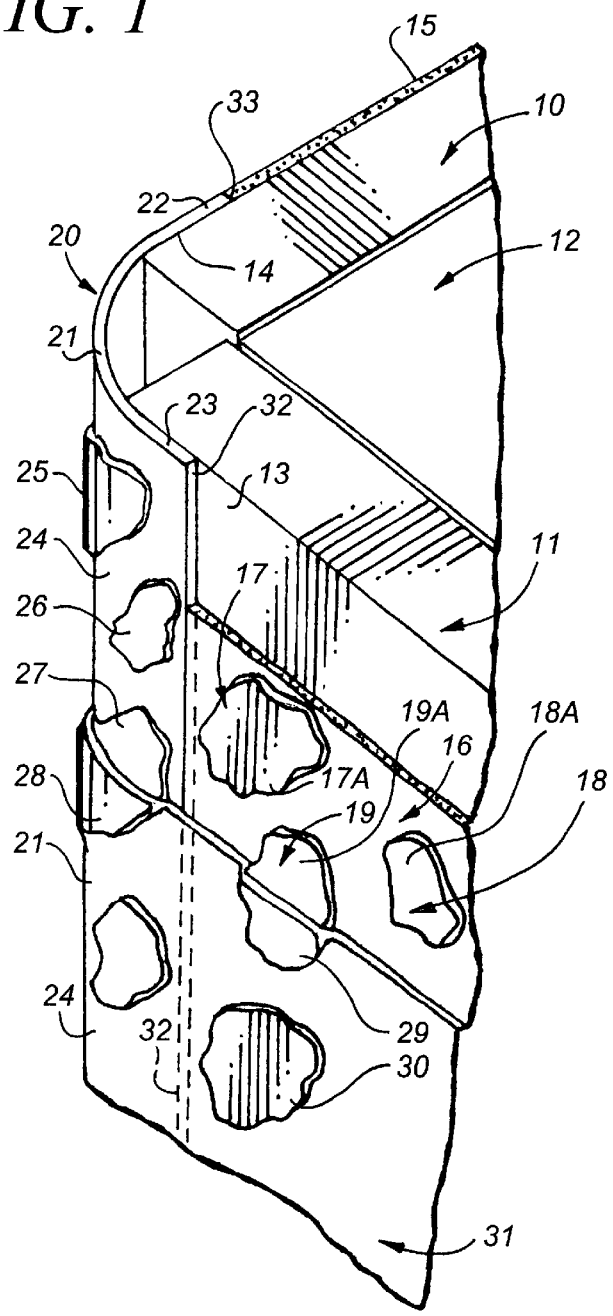
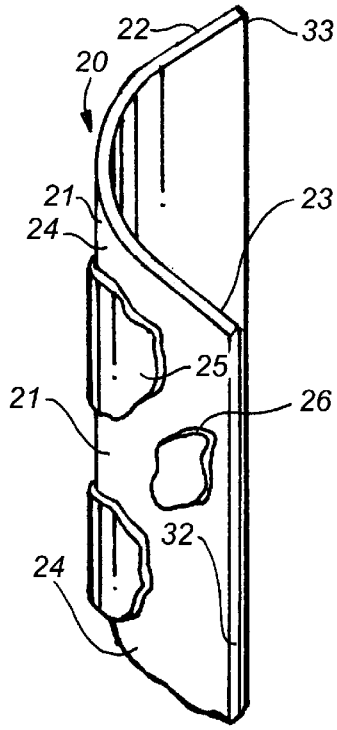
FIG. 2

METHOD OF TEXTURING DRYWALL CORNER BEAD AND WALL ADJACENT THE CORNER BEAD

This invention relates to corner beads and methods for installing the same.

More particularly, the invention relates to a method for texturing a corner bead and the wall adjacent the corner bead.

A corner bead is a thin, elongate, L-shaped piece of metal which typically is secured at wall corners where the linear ends of plaster board abut. A plurality of apertures are formed through the corner bead. Nails are hammered through the apertures through the plasterboard and into two-by-four pieces of wood behind the plasterboard in order to secure the corner bead in position at the wall corner. Drywall screws can also be utilized to secure a corner bead at a wall corner.

Corner beads are used on inner and outer corners. An example of an inner corner is where vertical walls meet to form a corner of a room such that the open space between the outer exposed surfaces of the walls extends from wall to wall through a horizontally oriented angle of ninety degrees. An example of an outer corner is where vertical walls meet to form a corner (at a doorway for example) such that the open space between the outer exposed surfaces of the walls extends from wall to wall through a horizontally oriented angle of two hundred and seventy degrees.

When an L-shaped corner bead is installed at an outer corner, the ridge or corner at the center of the bead where the two legs of the bead meet is readily touched and contacted.

When an L-shaped corner bead is installed at an inner corner, the ridge or corner at the center of the bead where the two legs of the bead meet is not readily touched and contacted. The walls forming the inner corner making touching the corner of the bead difficult. An inner corner can be formed by a pair of co-terminating vertical walls or by a vertical wall which co-terminates with a horizontally oriented wall like a ceiling or floor.

Once a corner bead is secured to an inner or outer corner, texture is applied to cover (at least partially) the plasterboard (or to cover another selected wall surface utilized in place of or over plasterboard) and to cover the corner bead, after which the wall and corner bead are painted. The texture comprises plaster or another comparable or desired material. Texture can be applied by hand, with a pressurized gun, or by any other desired means. The texture is applied in a selected pattern to form a patterned surface comprised of a combination of raised and low areas. The raised areas in the pattern surface can, by way of example and not limitation, comprise a plurality of plateaus, comprise a plurality of round, raised pebble-shaped areas, or comprise the combination of a plurality of plateaus and pebble shaped areas.

While corner beads and texture have long been applied to plasterboard, conventional techniques require labor intensive procedures. For example, when conventional corner bead is utilized, texture is applied both to the outer surface of the corner bead and to the plasterboard adjacent the corner bead. In particular, when texture is applied to a first wall on one side of the corner bead, some texture is also applied to the corner bead. Similarly, when texture is applied to a second wall on the other side of the corner bead, additional texture is applied to the corner bead. The second wall is at an angle, typically about ninety degrees, to the first wall. As a result, the thickness of the texture on the corner bead can be uneven or be too thick.

Another problem associated with corner beads is that corner beads mounted at outer corners are exposed such that the texturing covering the beads is readily contacted, cracked and chipped off the beads. During construction of a new residence this requires workman to sand, texture, and paint beads at outer corners to repair the texturing on the beads. This procedure is time intensive and expensive.

Accordingly, it would be highly desirable to provide an improved method and apparatus for texturing a wall and corner bead in order to simplify the process of texturing the wall and to minimize the likelihood that texturing on the corner bead of the wall will have to be repaired.

Therefore, it is a principal object of the invention to provide an improved method and apparatus for texturing a wall.

A further object of the invention is to provide an improved method and apparatus which substantially eliminates the risk that the texturing on a corner bead will be uneven or will be too thick.

Another object of the invention is to provide an improved method and apparatus which greatly minimizes the likelihood that a corner bead will have to be repaired to replace damaged texturing on the corner bead.

A further object of the invention is to provide an improved method and apparatus which facilitates the use of different texturing patterns in a residence.

These and other, further and more specific objects and advantages of the invention will be apparent to those skilled in the art from the following detailed description thereof, taken in conjunction with the drawings, in which:

FIG. 1 is a perspective view illustrating a corner bead constructed in accordance with the invention and installed on the outer corner of a wall in accordance with the method of the invention;

FIG. 2 is a perspective view of a portion of the corner bead of FIG. 1;

Figure 3:
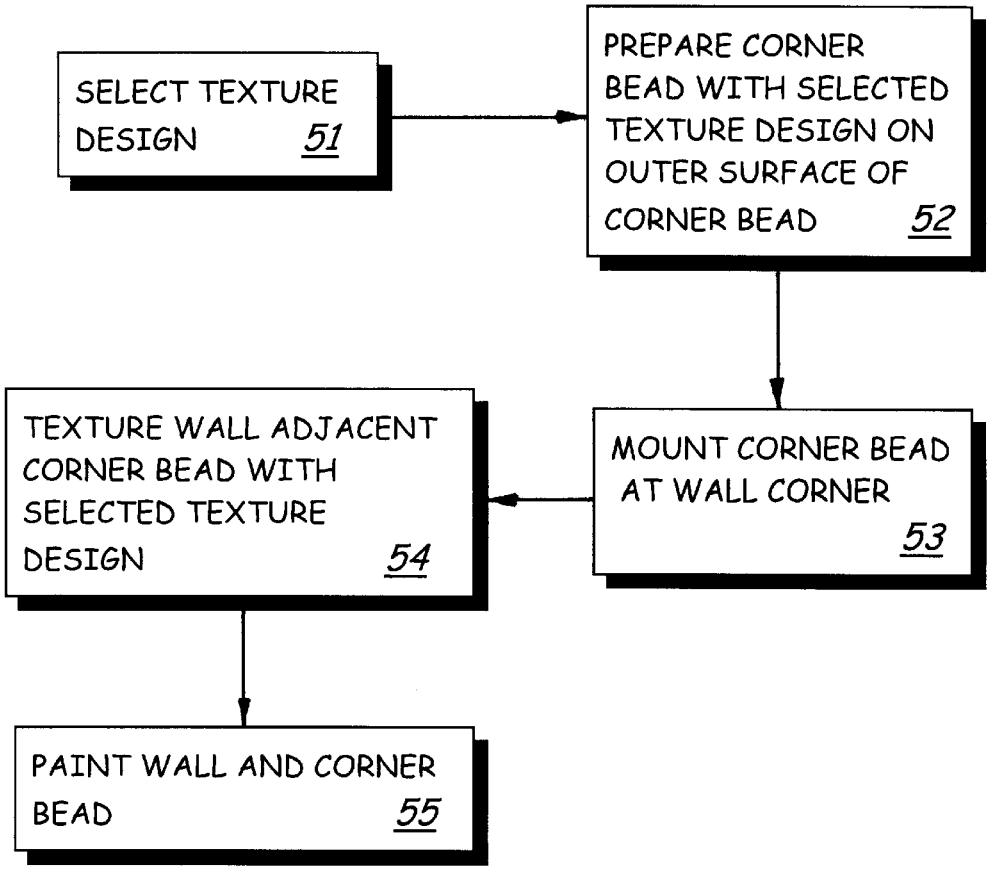
FIG. 3 is a block flow diagram illustrating the method of the invention.

Briefly, in accordance with the invention, I provide an improved method for texturing a wall. The wall includes a corner. The method includes the steps of selecting a texture pattern; providing a generally L-shaped corner bead having an outer surface, at least a portion of the outer surface having the texture pattern formed therein; mounting the corner bead at the corner; applying texture to the wall to form the texture pattern on the wall; and, painting the outer surface of the corner bead and the texture pattern on the wall.

Turning now to the drawings, which depict the presently preferred embodiments of the invention without limitation to the scope thereof, and in which like reference characters represent corresponding elements throughout the several views, FIG. 1 illustrates the method and apparatus of the invention. Sheetrock or drywall panels 10, 11 (or panels made of another desired material) are nailed or screwed to a framework which typically consists of wood two-by-fours 12 or of elongate metal members. Panel 10 includes flat rectangular outer surface 14. Panel 11 includes flat rectangular outer surface 13. The pattern of the texture to be applied to surfaces 13 and 14 is selected. While texture patterns can vary widely, for sake of example the pattern selected in FIG. 1 includes raised plateau-type areas 17 to 19. Each area 17 to 19 includes a substantially flat raised upper surface 17A to 19A, respectively.

Once the texture pattern is selected, a corner bead 20 is selected which has the selected texture pattern formed on a least a portion of the outer surface 24 of bead 20. Bead 20 includes an arcuate central section 21 integrally formed with flat rectangular flanges or legs 22, 23. In FIG. 1, raised plateau-type areas 25 to 27 are formed on portions of outer surface 24 of bead 20 such that the texture pattern on surface 24 generally is the same as the texture patterns formed by layers 15 and 16. Legs 22 and 23 are affixed or fastened to surfaces 13 and 14 in the orientation illustrated in FIG. 1. Nails, drywall screws, or any other desired means can be utilized to affix legs 22 and 23 to surfaces 14 and 13, respectively.

After bead 20 is affixed to the outer corner of abutting drywall sheets 10 and 11 in the manner noted above and in FIG. 1, a layer 16 of texture is applied to outer surface 13. In FIG. 1, layer 16 completely covers surface 13. As is well known, layer 16 need not completely cover all areas of surface 13, as in the case of skip troweling. Regardless of whether layer 16 completely covers surface 13, a texture pattern of raised spaced apart areas is formed on surface 13. The texture typically comprises plaster or a plaster-like material, but can be comprised of any desired material.

A layer 15 of texture is also applied to surface 14. When layer 15 is applied, a pattern of raised areas similar to that on surface 13 is produced. Consequently, the texture patterns on surface 24 and in layers 15 and 16 are identical or substantially identical.

After texture layers 15 and 16 are applied, a layer 31 of paint is applied to layers 15 and 16 and is applied to outer surface 24 of bead 20. The paint layer 31 covers up-raised areas 17, 18, 19,27,25,26 such that upraised areas 29, 30 result. Since the layer 31 of paint covering layers 15, 16 and surface 24 is generally of equal thickness at all or most points, after layer 31 is applied, a texture pattern similar to that of the pattern formed on surface 24 and formed in layers 15 and 16 results.

FIG. 2 further illustrates cove bead 20.

FIG. 3 sets forth the method of the invention, including the steps of "select texture design" 51, "prepare corner bead with selected texture design on outer surface of corner bead" 52, "mount corner bead at wall corner" 53, "texture wall adjacent corner bead with selected texture design" 54, and "paint wall and corner bead" 55.

Figure 4:
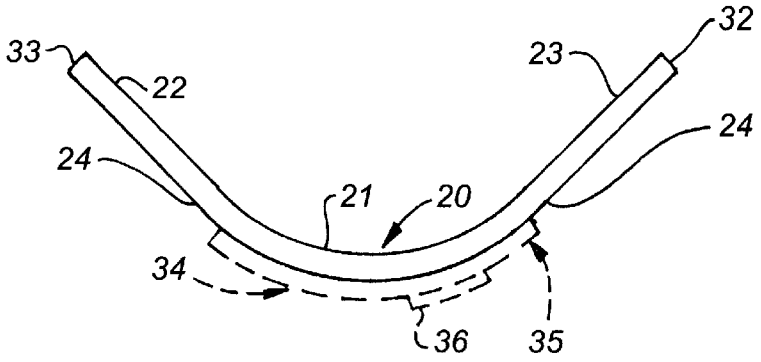
FIG. 4 is an end view illustrating another generally L-shaped corner bead which can be utilized in the invention.

FIG. 4 illustrates further cove bead 20. The texture design on surface 24 is omitted for sake of clarity. As indicated by dashed line 34, a texture design can be formed on surface 24 by adhering or otherwise affixing a strip 34 of embossed paper or other material to surface 24. When cove bead 20 comprises in its entirely metal, the upraised areas comprising a texture pattern can be produced by forming upraised areas on the periphery of a rotating wheel and by passing strip 34 between the periphery of the rotating wheel and the periphery of another wheel in order to press outwardly plastically portions of strip 34 to form spaced apart upraised areas 25, 26, etc. Any other desired means can be utilized to form beads 20 having a desired texture pattern on surface 24.

Each cove bead 20 can, as is well known in the art, be utilized on an outer corner or an inner corner in a room.

Figure 5:
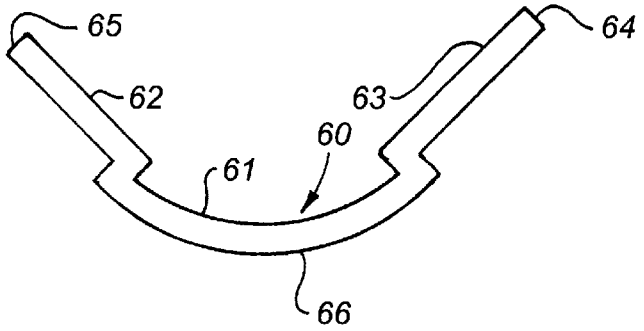
FIG. 5 is an end view illustrating still another generally L-shaped corner bead which can be utilized in the practice of the invention; and, FIG. 6 is an end view illustrating yet another generally L-shaped corner bead which can be utilized in the practice of the invention.

FIG. 5 illustrates another L-shaped cove bead 60 which can be utilized in the practice of the invention. Bead 60 includes arcuate section 61 and planar rectangular legs 62, 63 affixed to or integrally formed with section 61. Leg 62 includes elongate edge 65. Leg 64 includes elongate edge 64. Section 61 includes outer surface 66. A texture pattern can be formed on or in at least a portion of outer surface 66.

Figure 6:
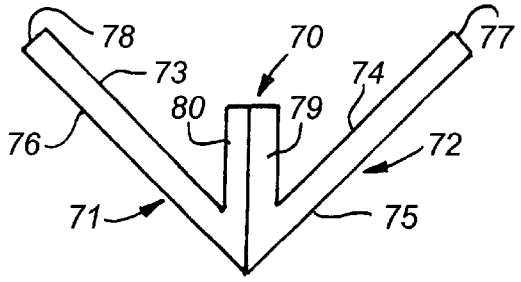

FIG. 6 illustrates still another L-shaped cove bead 70 which can be utilized in the practice of the invention. Bead 70 includes linear legs 71 and 72. Arm 79 is connected to leg 72. Arm 80 is connected to leg 73. Arms 79, 80 are adhered or otherwise fastened together to form bead 70. Leg 71 includes outer surface 76, inner surface 73, and elongate edge 78. Leg 72 includes outer surface 75, inner surface 74, and elongate edge 77. A texture pattern can be formed on or in a least a portion of outer surfaces 75, 76.

One advantage of the corner bead of the invention is that cove beads with a first texture pattern can be manufactured; cove beads with a second texture pattern different from the first texture pattern can be manufactured; cove beans with a third texture pattern different from the first and second patterns can be manufactured; etc. This enables a cove bead 20 to be selected which will match a plurality of different texture patterns which can be formed on surfaces 13 and 14.

An additional invention of the method of the invention is that it does not require that the surface of a cove bead 20 which includes a texturing pattern be covered with texture. The texture pattern is preformed in surface 24 of bead 20 in the manner illustrated in FIGS. 1 and 2. This significantly reduces the risk that the cove bead will have to be repaired because there is no texture plaster which can chip off the surface 24.

Having set forth the presently preferred embodiments of my invention in such terms to enable those skilled in art to understand and practice the invention, I claim:

1. A method for texturing a wall, said wall including a corner, said method comprising the steps of (a) selecting a texture pattern including a plurality of upraised, spaced apart areas;

(b) providing a generally L-shaped corner bead having an outer surface replicating said texture pattern;

(c) mounting said corner bead at said corner;

(d) applying texture to the wall adjacent said corner bead to form an outer wall surface replicating said texture pattern; and, (e) painting said outer surface of said corner bead and said outer wall surface, said texture pattern being shaped and dimensioned such that said texture pattern remains and is visible after said outer surface of said corner bead and said outer wall surface are painted in step (e).

2. A method for texturing a wall, said wall including a corner, said method comprising the steps of (a) selecting first and second texture patterns each including a plurality of upraised, spaced apart areas, said first texture pattern being different from said second texture pattern;

(b) providing at least first and second generally L-shaped corner beads, said first corner bead having an outer surface replicating said first texture pattern, said second corner bead having an outer surface replicating said second texture pattern;

(c) selecting one of said first and second texture patterns;

(d) selecting the one of said corner beads with said selected texture pattern;

(e) mounting said selected one of said corner beads on said corner;

(f) applying texture to the wall adjacent said corner bead to form an outer wall surface replicating said selected one of said texture patterns; and, (g) painting said outer surface of said corner bead and said outer wall surface with at least one coat of paint having a generally uniform thickness, said selected one of said texture patterns being shaped and dimensioned such that said selected one of said texture pattern remains and visible after said outer surface of said corner bead and said wall surface are painted in step (e).

* * * * *